US008795099B2

(12) United States Patent
Sato et al.

(10) Patent No.: US 8,795,099 B2
(45) Date of Patent: Aug. 5, 2014

(54) GOLF CLUB AND METHOD FOR ADJUSTING CHARACTERISTICS OF GOLF CLUB

(75) Inventors: Fumiaki Sato, Chichibu (JP); Takaharu Takechi, Tokyo (JP); Tomonori Kitagawa, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 293 days.

(21) Appl. No.: 13/365,314

(22) Filed: Feb. 3, 2012

(65) Prior Publication Data

US 2012/0208653 A1 Aug. 16, 2012

(30) Foreign Application Priority Data

Feb. 14, 2011 (JP) ..... 2011-028744

(51) Int. Cl.
*A63B 53/02* (2006.01)

(52) U.S. Cl.
USPC ..... 473/307; 473/288; 473/246; 473/309

(58) Field of Classification Search
CPC ..... A63B 53/06; A63B 53/065; A63B 53/16; A63B 59/0051; A63B 59/0055; A63B 2053/022; A63B 2053/023; A63B 2053/025; A63B 2053/026; A63B 2053/027
USPC ..... 473/307, 288, 244–248
See application file for complete search history.

(56) References Cited

U.S. PATENT DOCUMENTS

| | | | | |
|---|---|---|---|---|
| 2,219,670 | A * | 10/1940 | Wettlaufer | 473/247 |
| 4,854,582 | A * | 8/1989 | Yamada | 473/309 |
| 4,948,132 | A * | 8/1990 | Wharton | 473/246 |
| 5,374,062 | A * | 12/1994 | Kochevar | 473/312 |
| 7,427,239 | B2 * | 9/2008 | Hocknell et al. | 473/307 |
| 7,651,407 | B2 * | 1/2010 | Tsai et al. | 473/306 |
| 8,182,357 | B2 * | 5/2012 | Moore | 473/246 |
| 8,398,503 | B2 * | 3/2013 | Beach et al. | 473/245 |
| 8,491,411 | B2 * | 7/2013 | Deshiell et al. | 473/320 |
| 8,545,345 | B2 * | 10/2013 | Lo et al. | 473/307 |
| 8,668,597 | B2 * | 3/2014 | Yamamoto | 473/307 |
| 2005/0049072 | A1 * | 3/2005 | Burrows | 473/305 |
| 2008/0280694 | A1 * | 11/2008 | Hocknell et al. | 473/288 |
| 2009/0124407 | A1 * | 5/2009 | Hocknell et al. | 473/288 |
| 2010/0016094 | A1 * | 1/2010 | Hocknell et al. | 473/288 |

(Continued)

FOREIGN PATENT DOCUMENTS

| | | | |
|---|---|---|---|
| JP | 2000-5349 | A | 1/2000 |
| JP | 2003-70940 | A | 3/2003 |
| JP | 2006-42951 | A | 2/2006 |
| JP | 2008-29691 | A | 2/2008 |

(Continued)

*Primary Examiner* — Stephen L. Blau

(74) *Attorney, Agent, or Firm* — Sughrue Mion, PLLC

(57) ABSTRACT

A golf club includes: a shaft; a head mounted on a leading end of the shaft; and a substantially cylindrical shaft case fixed to the leading end of the shaft, wherein: the shaft case is inserted into the tubular portion of the hosel of the head; the tubular portion includes a partition plate section in the lower portion thereof; a spacer is interposed between the leading end of the shaft case and partition plate section; the shaft case is unrotatably engaged with the spacer; the spacer and partition plate section respectively include stopper portions for preventing the rotation of the spacer; and a bolt inserted through bolt insertion holes respectively formed in the partition plate section and spacer from the sole side of the head is screwed into the shaft case, whereby the shaft case is fixed to the head.

5 Claims, 10 Drawing Sheets

(56) References Cited

U.S. PATENT DOCUMENTS

| | | | | |
|---|---|---|---|---|
| 2010/0120551 | A1* | 5/2010 | Hocknell et al. | 473/288 |
| 2010/0197422 | A1* | 8/2010 | Thomas et al. | 473/307 |
| 2011/0190071 | A1* | 8/2011 | Yamamoto | 473/307 |
| 2012/0064990 | A1* | 3/2012 | Hocknell et al. | 473/288 |
| 2012/0165111 | A1* | 6/2012 | Cheng | 473/305 |
| 2013/0059676 | A1* | 3/2013 | Boyd et al. | 473/307 |

FOREIGN PATENT DOCUMENTS

| | | | | |
|---|---|---|---|---|
| JP | 2008-259862 | A | | 10/2008 |
| JP | 2009-148560 | A | | 7/2009 |
| JP | 2009-291602 | A | | 12/2009 |
| JP | 2010-5197 | A | | 1/2010 |
| JP | 2010051590 | A | * | 3/2010 |
| JP | 2011-4801 | A | | 1/2011 |

* cited by examiner

GOLF CLUB AND METHOD FOR ADJUSTING CHARACTERISTICS OF GOLF CLUB

BACKGROUND

1. Field of the Invention

The present invention relates to a golf club and, especially, relates to a golf club whose characteristics such as the lie angle, slice angle and face progression can be adjusted easily. Also, the invention relates to a method for adjusting the characteristics of such golf club.

2. Description of the Related Art

A golf club is constituted of a shaft and a head mounted on the leading end portion of the shaft. A grip is mounted on the base end side of the shaft.

In an ordinary conventional golf club head, a hosel hole is formed directly in the head, while a shaft is inserted into the hosel hole and is fixed thereto with an adhesive. Here, as the adhesive, generally, there is used an epoxy system adhesive. To replace the shaft, the hosel portion may be heated to destroy its texture constituted of epoxy resin hardened material, whereby the shaft can be pulled out.

In such ordinary conventional golf club, the shaft replacement takes time and labor. Also, the characteristics of the golf club such as the lie angle, slice angle and face progression cannot be adjusted.

JP-A-2011-4801 discloses a golf club whose shaft can be replaced easily and whose characteristics such as the lie angle, slice angle and face progression can be adjusted, and a method for adjusting such characteristics. The head of the golf club disclosed in JP-A-2011-4801 is a golf club head including a hosel insertion hole for mounting the leading end of the shaft, which includes a female screw formed in the entrance portion inner peripheral surface of the hosel insertion hole, a hosel including a shaft case insertion hole and removably mounted on the deep portion of the hosel insertion hole, a shaft case including a shaft insertion hole and having a leading end side removably mounted into the shaft case insertion hole, a ring holder fitted with the outer surface of the shaft case and immovable in the axial direction, and a screw member fitted with the outer surface of the ring holder rotatably in the peripheral direction and immovable in the axial direction, while a male screw formed on the outer peripheral surface of the screw member is threadedly engaged with the female screw.

In the golf club disclosed in JP-A-2011-4801, by mounting the screw member onto the female screw of the hosel mounting hole or removing the screw member therefrom, the shaft case can be fixed to or pulled out from the hosel mounting hole. Thus, the hosel and ring holder are replaced with other hosel and ring holder different in the lie angle, slice angle or face progression, or the peripheral direction phase of the hosel is changed, and the shaft case with a shaft is mounted again onto the head main body through this hosel.

For example, when the currently used hosel and ring holder are replaced with new hosel and ring holder in which the axis of its shaft extends in a direction oblique to the axis of the hosel insertion hole (for example, in an obliquely crossing direction), the mounting direction of the shaft relative to the head main body is changed to thereby change the lie angle and slice angle.

In a golf club constituted of quite the same shaft and the same head main body, only the lie angle and slice angle can be adjusted.

Also, in the case that the current hosel and ring holder are replaced with new hosel and ring holder in which the axis position of the shaft case insertion hole is translated and shifted from the axis position of the hosel insertion hole, in a golf club constituted of quite the same shaft and the same head main body, the face progression and the distance (gravity distance) from the shaft to the center of gravity can be adjusted.

Further, in JP-A-2011-4801, by replacing the shaft with a shaft case without replacing the hosel and ring holder, the shaft can be replaced. That is, as a shaft case, a shaft case of quite the same type is previously prepared, and a shaft having a different characteristic is fixed to this shaft case to thereby provide a shaft case/shaft connected member; and, this shaft case/shaft connected member is substituted for an old shaft case/shaft connected member and is mounted on the hosel of the relevant head, thereby being able to provide a golf club different only in the shaft.

The golf club disclosed in JP-A-2011-4801 requires the ring holder fitted with the outer surface of the shaft case and the screw member fitted with the outer surface of the ring holder, resulting in the relatively expensive cost of the composing members.

SUMMARY

The invention has an object to provide a golf club in which a shaft can be replaced easily, its characteristics such as the lie angle, slide angle and face progression can be adjusted, and also which is lower in the manufacturing cost than the golf club disclosed in JP-A-2011-4801, and a method for adjusting the characteristics of this golf club.

According to a first aspect of the invention, there is provided a golf club including: a shaft; a head mounted on a leading end of the shaft; and a substantially cylindrical shaft case fixed to the leading end of the shaft, wherein: the shaft case is inserted into the tubular portion of the hosel of the head; the tubular portion includes a partition plate section in the lower portion thereof; a spacer is interposed between the leading end of the shaft case and partition plate section; the shaft case is unrotatably engaged with the spacer; the spacer and partition plate section respectively include stopper portions for preventing the rotation of the spacer; and a bolt inserted through bolt insertion holes respectively formed in the partition plate section and spacer from the sole side of the head is screwed into the shaft case, whereby the shaft case is fixed to the head.

According to a second aspect of the invention, the axis of the shaft is coaxial with the axis of the tubular portion.

According to a third aspect of the invention, the axis of the shaft is inclined with respect to the axis of the tubular portion.

According to a fourth aspect of the invention, the axis of the shaft and the axis of the tubular portion are parallel to each other.

According to a fifth aspect of the invention, the spacer includes a shaft case insertion hole; and the lower end side of the shaft case and the shaft case insertion hole respectively have a polygonal section shape and are engaged with each other.

According to a sixth aspect of the invention, there is provided a method for adjusting the characteristics of a golf club including: a shaft; a head mounted on a leading end of the shaft; and a substantially cylindrical shaft case fixed to the leading end of the shaft, wherein: the shaft case is inserted into the tubular portion of the hosel of the head; the tubular portion includes a partition plate section in the lower portion thereof; a spacer is interposed between the leading end of the shaft case and partition plate section; the shaft case is unrotatably engaged with the spacer; the spacer and partition plate section respectively include stopper portions for preventing the rotation of the spacer; and a bolt inserted through bolt insertion holes respectively formed in the partition plate section and spacer from the sole side of the head is screwed into the shaft case, whereby the shaft case is fixed to the head, the method including: removing the bolt; separating the shaft case from the spacer rotating the shaft case to change the position of the shaft insertion hole or the inclination of the shaft; and engaging the shaft case with the spacer again by using the bolt.

According to a seventh aspect of the invention, there is provided a method for replacing the shaft of a golf club with a new shaft and adjusting the characteristics of the golf club having the new shaft, the method including: providing a golf club including: a shaft; a head mounted on a leading end of the shaft; and a substantially cylindrical shaft case fixed to the leading end of the shaft, wherein: the shaft case is inserted into the tubular portion of the hosel of the head; the tubular portion includes a partition plate section in the lower portion thereof; a spacer is interposed between the leading end of the shaft case and partition plate section; the shaft case is unrotatably engaged with the spacer; the spacer and partition plate section respectively include stopper portions for preventing the rotation of the spacer; and a bolt inserted through bolt insertion holes respectively formed in the partition plate section and spacer from the sole side of the head is screwed into the shaft case, whereby the shaft case is fixed to the head; previously fixing a new shaft to a new shaft case to provide a new shaft case/shaft connected member; removing the shaft case and the shaft in a state that the shaft case is connected with the shaft from the head, and mounting the new shaft case/shaft connected member onto the head.

In the golf club of the invention, since the shaft case is inserted into the tubular portion of the hosel and is fixed by the bolt inserted from the sole side, the ring holder and annular screw member used in JP-A-2011-4801 can be eliminated and thus the cost of the present golf club can be reduced.

In the golf club of the invention, the spacer is interposed between the bottom portion of the hosel hole of a hosel and the leading end portion of the shaft case and the rotation of the spacer is prevented by the stopper portions. Also, since the leading end portion of the shaft case and spacer are unrotatably engaged with each other, the shaft case can be positioned in its peripheral direction.

In the shaft replacing method of the invention, when the bolt is loosened and removed, the shaft case can be pulled out from the tubular portion of the hosel.

Therefore, for example, in the case that a shaft case with the axis of a shaft extending in an oblique direction (for example, in an obliquely crossing direction) with respect to the axis of a shaft case insertion hole is used, by changing the peripheral direction phase of the shaft case, the mounting direction of the shaft on the head main body can be changed, whereby the lie angle and slice angle can be changed.

Thus, in a golf club including quite the same shaft and head main body, only the lie angle or slice angle can be adjusted.

Also, in the case that a shaft case with the axial position of a shaft case insertion hole translated and shifted from the axial position of a hosel insertion hole is used, by changing the peripheral direction phase of the shaft case, in a golf including quite the same shaft and quite the same head main body, the face progression and the distance (gravity distance) from the shaft to the center of gravity can be adjusted.

According to the invention, a shaft case of quite the same type as a current shaft case is previously prepared, a shaft having different characteristics is fixed to the prepared shaft case to provide a shaft case/shaft connected member, and this shaft case/shaft connected member is substituted for a current shaft case/shaft connected member and is mounted onto the hosel of the head, thereby being able to provide a golf club having a different shaft.

Thus, the invention can save the conventionally required troublesome labor and time to destroy the texture of adhesive by heating and mount a new shaft again with an adhesive. Therefore, the shaft case/shaft connected member can be removed from the head of a golf club just after it is used to try to hit a ball, and another shaft case/shaft connected member having different characteristics can be mounted on this head and the golf club can be used immediately for another trial. This allows a golfer to find out a proper golf club in a golf shop or the like quite easily. Also, the shaft can be evaluated without paying attention to individual differences between heads.

Recently, there has been developed a system in which, in order for a golfer to find out a golf club fitting his or her skill, using a computer or a high speed camera, the golfer can find out a golf club fitting him or her. In this system, a golfer tries to swing individual commercial clubs and compares them based on their head speeds and launch angles to thereby find one fitting the golfer.

On the other hand, according to the golf club of the invention, by changing the position relationship between the same shaft and head to change the gravity distance and face progression of the club, a golfer can easily realize differences between the flying characteristics (such as the launch angle and spin) of balls hit out, or the golfer can apply only shafts to the same head one after another sequentially and can realize differences between the shafts only. Also, a golf player can replace the shaft according to his or her physical condition on the play day, or can adjust the lie angle, slice angle and face progression with the shaft remaining unchanged.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Now, description will be given below of the preferred embodiments of the invention with reference to the drawings.

Figure 1:
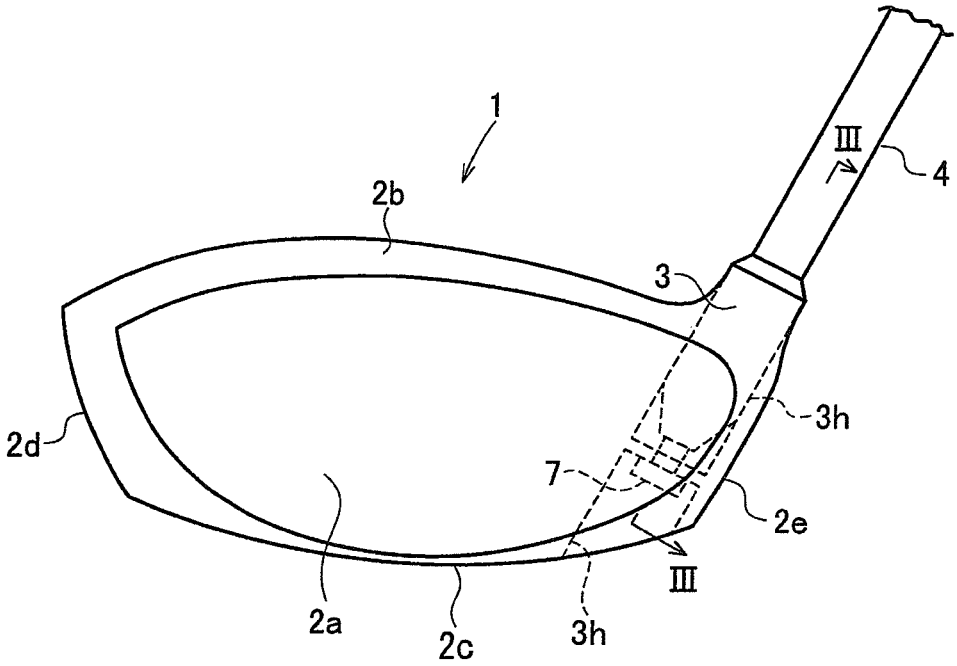
FIG. 1 is a front view of a head according to a first embodiment of the invention.
Figure 2:
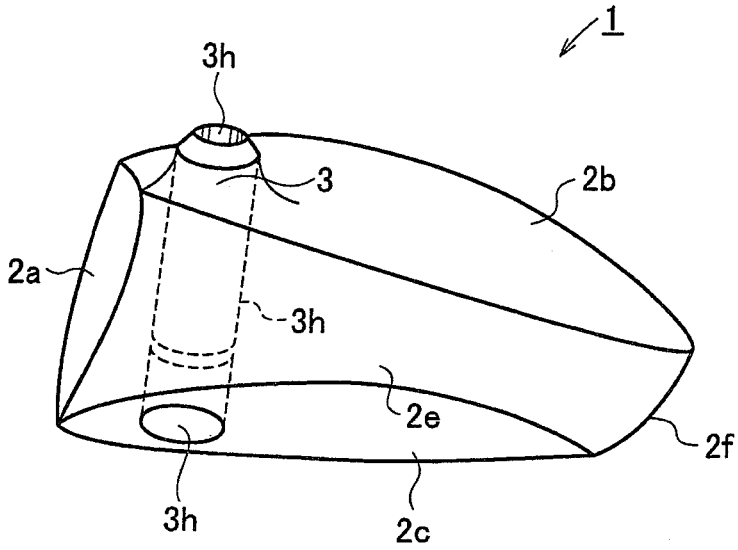
FIG. 2 is a side view of the heel side of the head.
Figure 3:
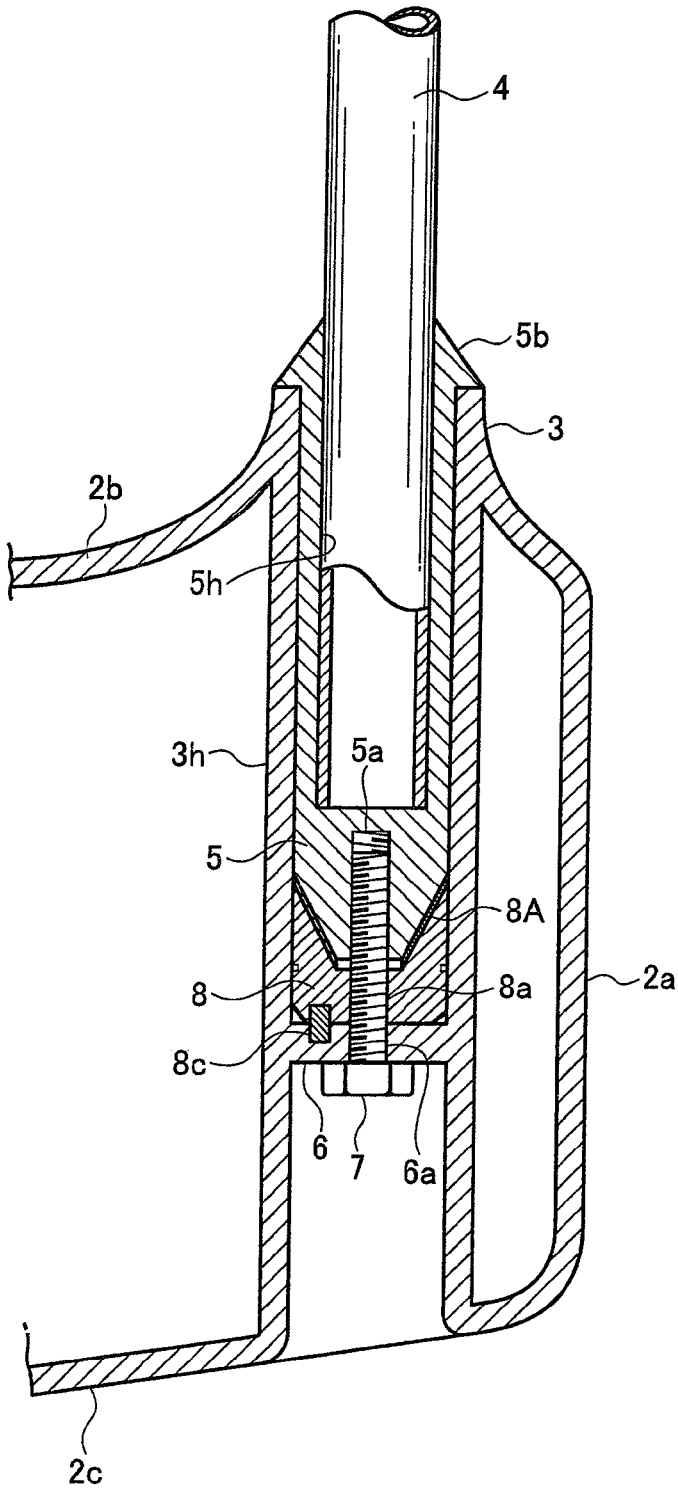
FIG. 3 is a section view taken along the 111-111 line shown in FIG. 1.
Figure 4:
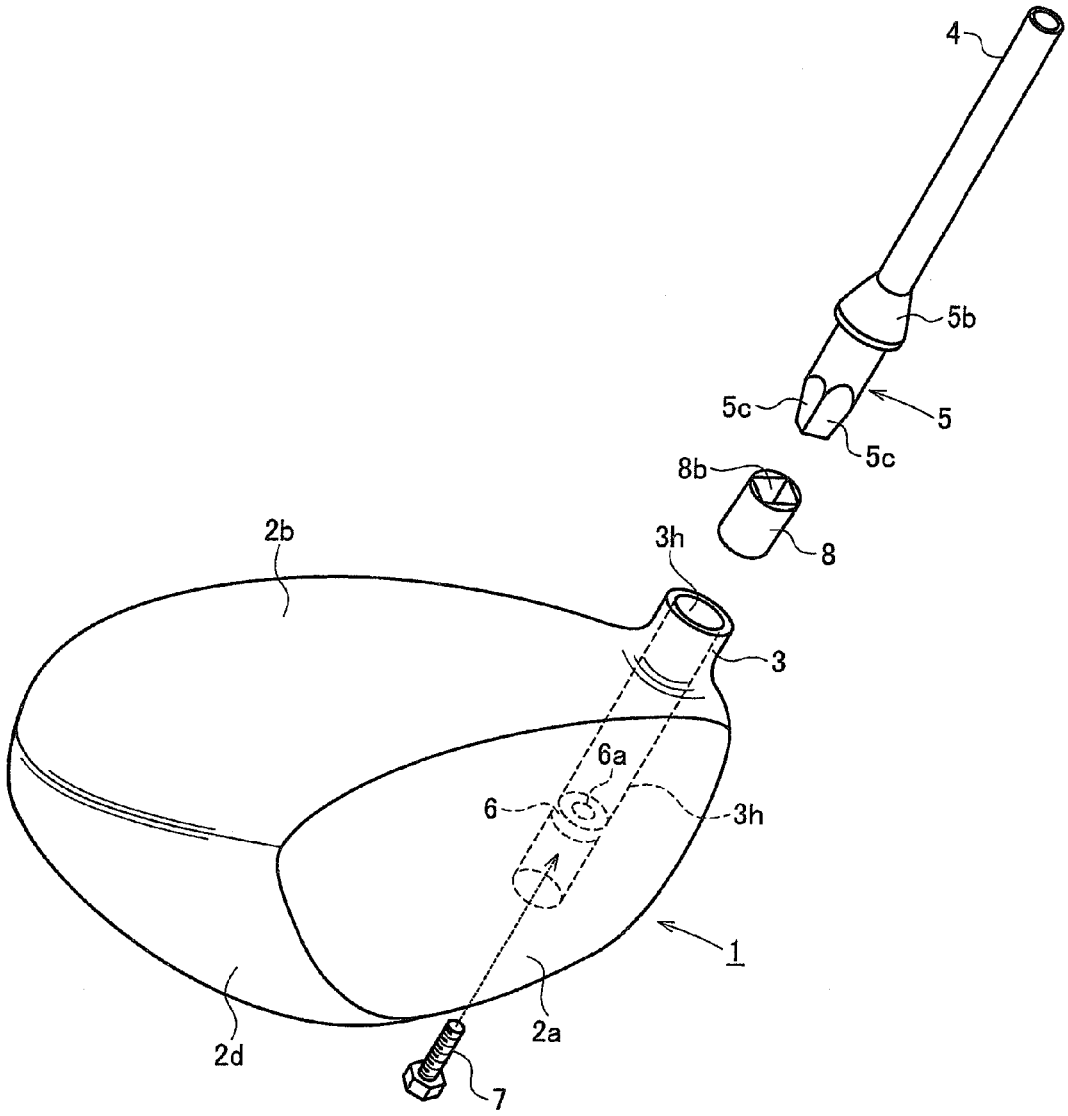
FIG. 4 is an exploded perspective view of a golf club.
Figure 5:
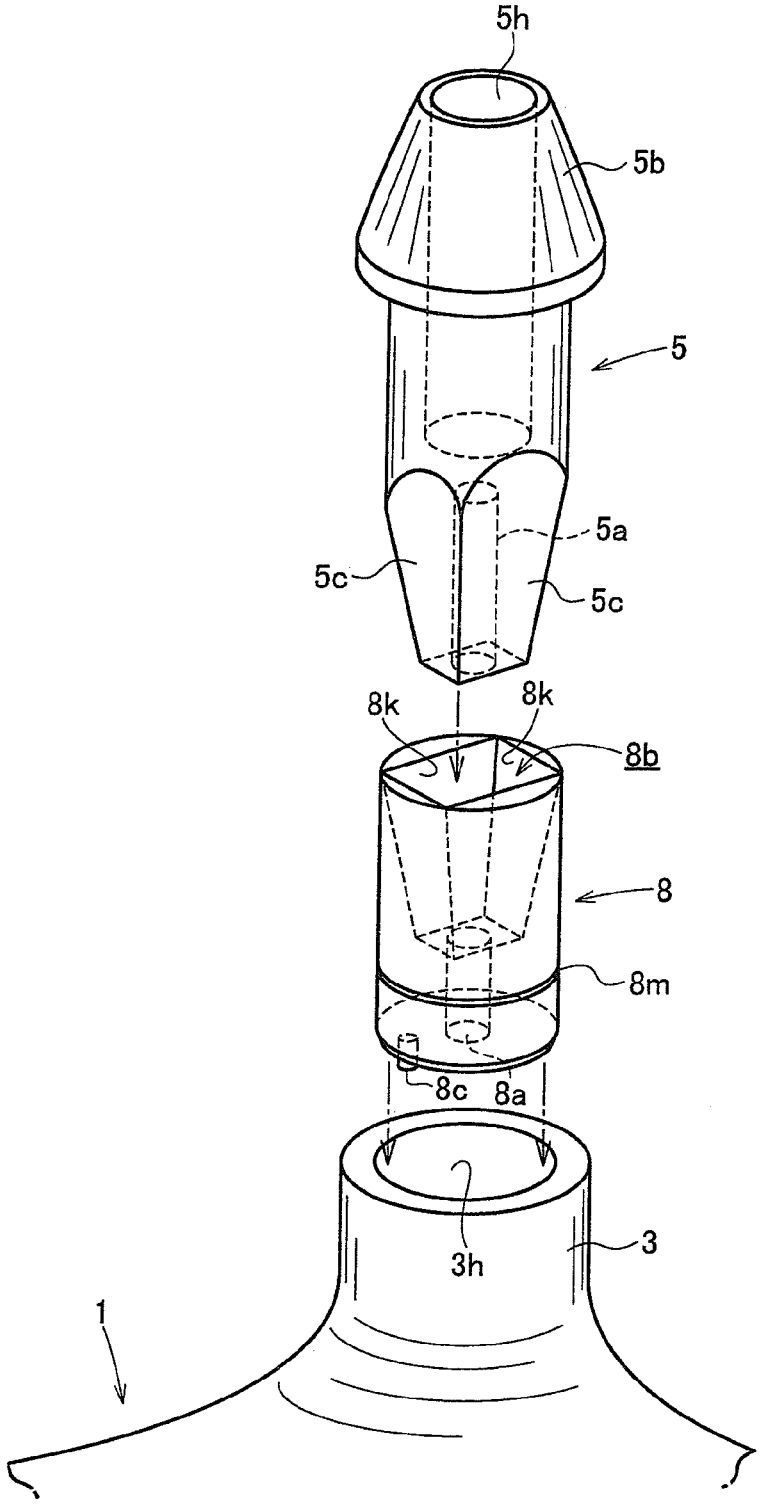
FIG. 5 is a perspective view of a hosel, a spacer and a shaft case.
Figure 6A:
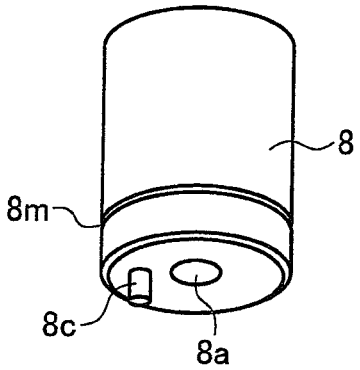
FIGS. 6A and 6B are structure views of the tubular portion of a hosel and a spacer according to the first embodiment of the invention.
Figure 6B:
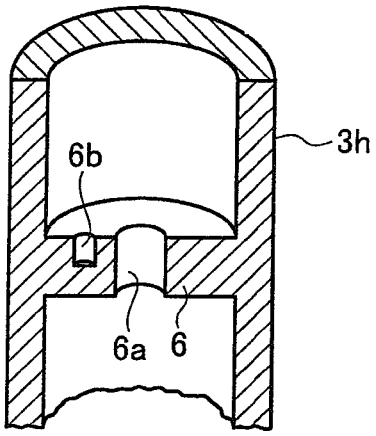

FIG. 1 is a front view of the head neighboring portion of a golf club according to a first embodiment, FIG. 2 is a side view of the heel side portion of the head, FIG. 3 is a section view taken along the III-III line shown in FIG. 1, FIG. 4 is an exploded perspective view of the golf club, FIG. 5 is a perspective view of a hosel, a spacer and a shaft case, and FIGS. 6A and 6B are structure views of the spacer and hosel.

In this golf club, a shaft 4 is mounted on the hosel 3 of a head 1 through a shaft case 5, a spacer 8 and a bolt 7.

The head 1 is hollow for the wood and includes a face portion 2*a*, a crown portion 2*b*, a sole portion 2*c*, a toe portion 2*d*, a heel portion 2*e* and a back portion 2*f*.

As shown in FIG. 3, the hosel 3 is disposed on the face portion 2*a* side and heel portion 2*e* side of the crown portion 2*b*. A tubular portion 3*h* having the same inside diameter as the hosel 3 extends, along the hosel 3, coaxially with the hosel 3 up to the sole portion 2*c*. The shaft case 5 is inserted into this tubular portion 3*h* and is fixed by the bolt 7. The tubular portion 3*h* includes a partition plate section 6 extending perpendicularly to the axial direction of the tubular portion 3*h*. The spacer 8 is placed on the upper side of the partition plate section 6. The bolt 7 is inserted upwardly from below through bolt insertion holes (openings) 6*a*, 8*a* respectively formed in the partition plate section 6 and spacer 8, and is screwed into the female screw hole 5*a* of the shaft case 5.

As shown in FIGS. 4 and 5, the outer periphery of the spacer 8 has a cylindrical shape. The spacer 8 includes a shaft case insertion hole 8*b* which extends downwardly from the upper end face of the spacer 8. The inner peripheral surface of this shaft case insertion hole 8*b* has a square pyramid shape the diameter of which reduces toward its deep side (lower end side) and includes four slopes 8*k* (FIG. 5) extending perpendicularly to the axis of the spacer 8. A crossing angle (included angle) between a pair of mutually opposed slopes 8*k*, preferably, may be 10~30°, especially, 15~20°. The upper end of the bolt insertion hole 8*a* is opened on the bottom surface of this shaft case insertion hole 8*b*.

As shown in FIGS. 3 to 5, the shaft case 5 is a cylindrical member having a diameter slightly smaller than that of the tubular portion 3*h* and includes an insertion hole 5*h* for insertion of the shaft 4 extending from the upper end side toward the lower end side. The shaft 4 is inserted into this shaft insertion hole 5*h* and is fixed to the shaft case 5 with an adhesive. The depth of the shaft insertion hole 5*h*, preferably, may be 10 mm or more, for example, 10~50 mm, especially, about 20~40 mm.

The shaft case 5 includes an outward facing collar-shaped flange portion 5*b* existing in its upper end. The upper surface of the flange portion 5*b* has a taper shape the diameter of which decreases as it goes upward. However, this is not limitative.

As shown in FIGS. 4 and 5, the outer surface of the lower portion of the shaft case 5 has a square pyramid shape (exactly, a truncated square pyramid shape) the diameter of which reduces as it goes toward its lower end, and includes four slopes 5*c*. The slopes 5*c* are disposed symmetrically around the axial line of the shaft case 5. A crossing angle between a pair of mutually opposed slopes 5*c*, 5*c* is the same as the crossing angle between the pair of mutually opposed slopes 8*k*, 8*k*. An elastic member 8A (FIG. 3) is interposed between the slopes 5*c* of the shaft case 5 and the slopes 8*k* of the hosel insertion hole 8*b*, thereby preventing the backlash of the shaft case 5.

The outer peripheral surfaces of the shaft case insertion hole 8*b* of the spacer 8 and the lower portion of the shaft case 5, in this embodiment, respectively have a regular square pyramid shape. However, the shape may also be a regular polygonal pyramid such as a regular triangular pyramid, a regular hexagonal pyramid, and a regular octagonal pyramid.

As a stopper portion for preventing the rotation of the spacer 8 on its axis, as shown in FIGS. 6A and 6B, there is formed a recessed portion 6*b* in the upper surface of the partition plate section 6 and there is provided a projecting portion 8*c* on the lower surface of the spacer 8, while the recessed portion 6*b* and projecting portion 8*c* are engaged with each other. The projecting portion 8*c* may be formed integrally with the spacer 8 by cutting the spacer 8. However, to form the projecting portion 8*c*, preferably, a dowel hole may be formed in the bottom surface of the spacer 8, a dowel pin may be inserted into the dowel hole and may be fixed by adhesion, by welding, by brazing or by similar means, because this is simple.

The spacer 8 is disposed in the deepest portion of the tubular portion 3*h* with the projecting portion 8*c* being inserted into the recessed portion 6*b* and, preferably, it may be bonded to the partition plate section 6 with an adhesive. Here, the outer peripheral portion of the lower end of the spacer 8 is chamfered, thereby allowing the excess of the adhesive to go round the side surface thereof easily. As shown in FIG. 5, a groove 8*m* is formed in the outer peripheral surface of the spacer 8 to extend round it, thereby being able to store the adhesive having gone round it. The adhesive stored in the groove 8*m* serves as an anchor for fixing the spacer 8.

To assemble the golf club, the spacer 8 is previously disposed in the deepest portion of the tubular portion 3*h* and is fixed with an adhesive. Also, as shown in FIG. 4, the shaft case 5 is previously fixed to the leading end of the shaft 4 using an adhesive to prepare a shaft case/shaft connected member. Preferably, the adhesive may be applied to the outer peripheral surface of the leading end portion of the shaft 4 and the shaft 4 may be inserted into the deepest portion of the shaft insertion hole 5*h* of the shaft case 5. As an adhesive, preferably, an epoxy system adhesive or the like may be used.

Figure 10:
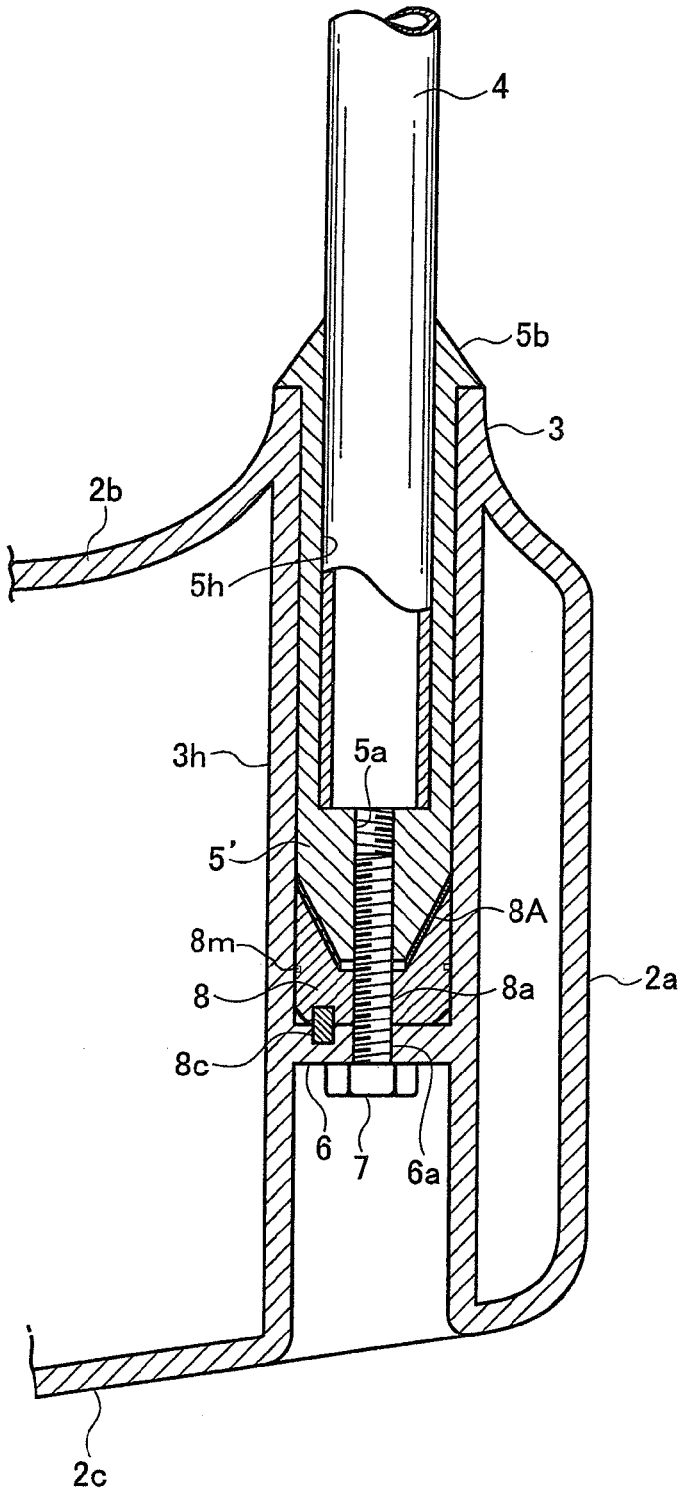
FIG. 10 is a section view of a fifth embodiment.

Here, in FIG. 3, the female screw hole 5*a* does not penetrate through the shaft case 5. However, like a shaft case 5' shown in FIG. 10, the female screw hole 5*a* may penetrate through the shaft case 5. In this case, when the shaft 4 is inserted into the hole 5*h* of the shaft case 5, the air flows out through the female screw hole 5*a*. As shown in FIG. 3, in the case that the female screw hole 5*a* is formed not to penetrate through the shaft case 5, there may also be formed an air let-out small hole which allows the female screw hole 5*a* and hole 5*h* to communicate with each other.

The shaft case 5 of the shaft case/shaft connected member is inserted into the tubular portion 3*h*, the leading end of the shaft case 5 is inserted into the shaft case insertion hole 8*b*, and the slopes 5*c*, 8*k* are engaged with each other. Next, the bolt 7 is screwed into the female screw hole 5*a* through the bolt insertion holes 6*a*, 8*a*.

Thus, as shown in FIG. 3, the shaft case 5 is fixed to the head 1. Since the shaft case 5 and shaft 4 are firmly bonded to each other with the adhesive, there is completed a golf club in which the shaft 4 and head 1 are formed as an integral body. Since the slopes 5*c* of the shaft case 5 are engaged with the slopes 8*k* of the spacer 8 and the projecting portion 8*c* of the spacer 8 is engaged with the recessed portion 6*b* of the partition plate section 6, the peripheral direction phase of the shaft 4 and shaft case 5 can be determined accurately. Also, the torque direction fixation rigidity of the shaft 4 and shaft case 5 is high.

Also, since the leading end portion of the shaft case 5 is tapered due to provision of the four slopes 5*c*, the shaft case 5 can be easily inserted into the tubular portion 3*h*.

Here, the spacer 8 is a short member to be disposed only in the deep portion of the tubular portion 3*h* and is light in weight.

According to the invention, the shaft of the golf club can also be replaced easily.

To replace the shaft of the golf club, a shaft case of the same type as the shaft case 5 may be previously fixed with an adhesive to a new shaft to replace.

The bolt 7 of the existing golf club is removed and the old shaft 4 is removed from the head 1 together with the old shaft case 5. Next, the new shaft with a shaft case (a shaft case/shaft connected member) is inserted into the head 1 and is fixed by the bolt 7.

Thus, the mounting and replacement of the shaft can be carried out very simply and quickly. Here, conventionally, in the shaft replacement, the hosel portion of an existing golf club is heated to destroy the texture of the hardened adhesive resin and, after the shaft is removed, a new shaft is fixed with an adhesive. Thus, it takes several hours to about one day. On the other hand, in the above embodiment, since the shaft case 5 is previously mounted on the new shaft with an adhesive, the shaft replacement can be completed in about several minutes. Therefore, there can be realized a use system in which shafts each with a shaft case of various specifications can be prepared and a golfer can try to hit a ball while mounting different shafts sequentially on the same head 1.

Here, in FIGS. 1 to 6B, the shaft 4 is arranged coaxially with the axis of the tubular portion 3*h*. However, as shown in FIGS. 7 and 8, the position and inclination direction of this shaft 4 can be changed.

Figure 7:
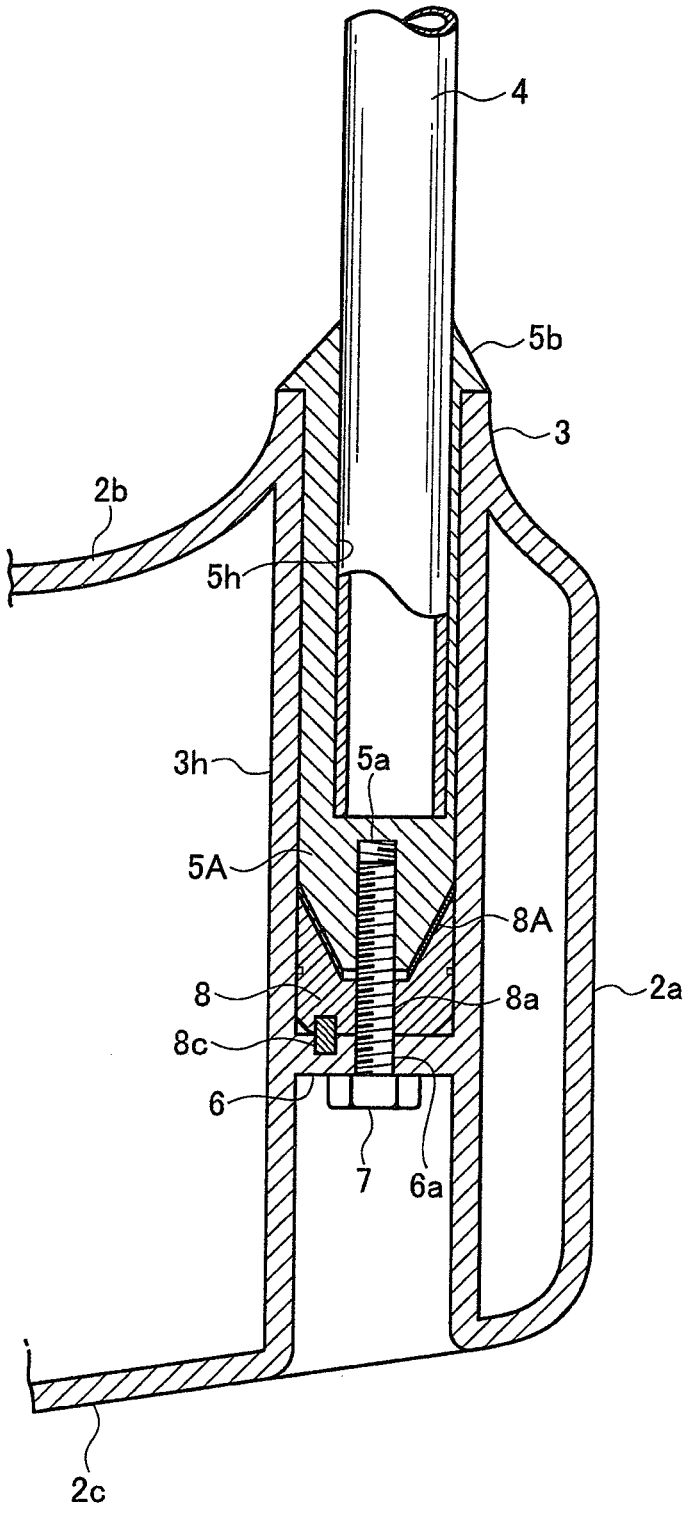
FIG. 7 is a section view of a second embodiment.

In the case of a shaft case 5A shown in FIG. 7, the shaft insertion hole 5*h* is shifted from the axis position of the shaft case 5. The axis of the shaft insertion hole 5*h* is parallel to the axis of the tubular portion 3*h* and is slightly (for example, 0.5~4 mm) spaced therefrom.

Figure 8:
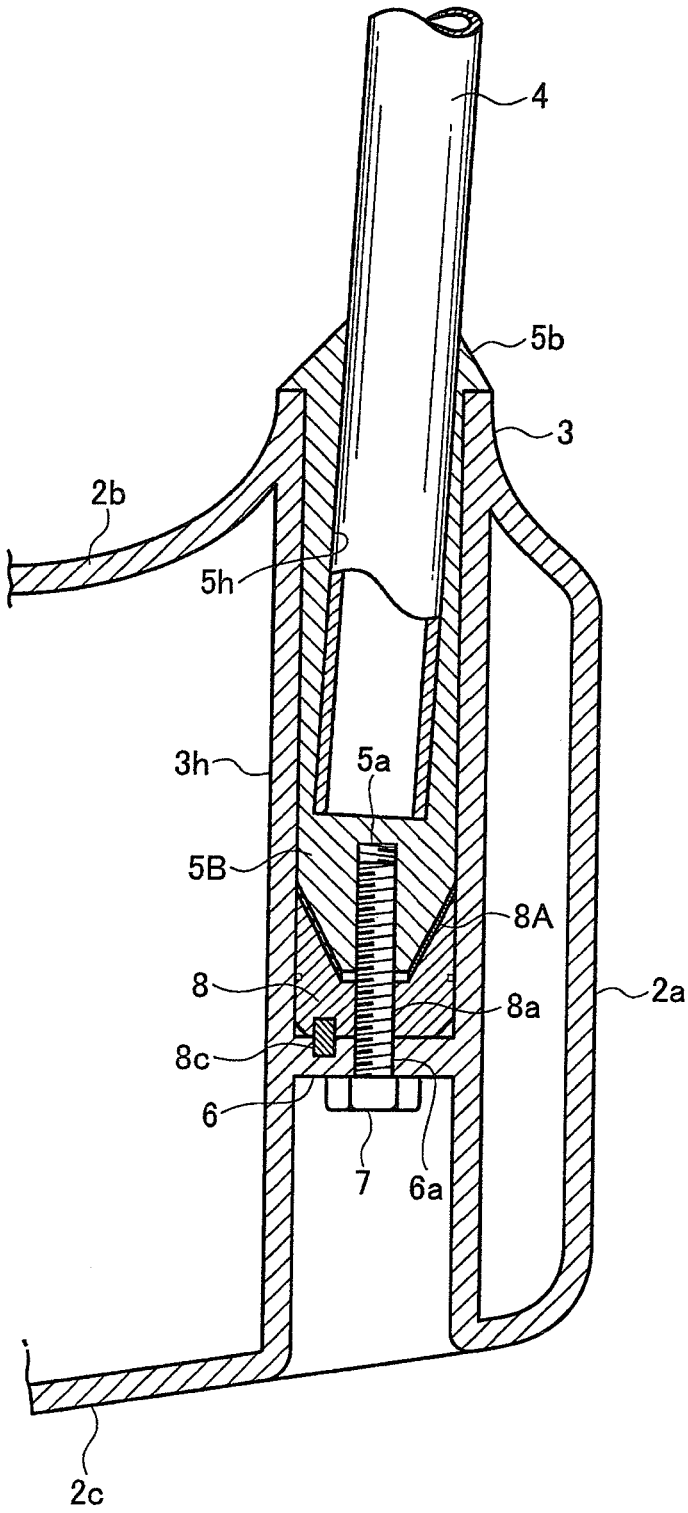
FIG. 8 is a section view of a third embodiment.

In the case of a shaft case 5B shown in FIG. 8, the axial direction of the shaft insertion hole 5*h* is inclined with respect to the axial direction of the tubular portion 3*h*. A crossing angle between the two axial lines, preferably, may be 0.1~5.0°, especially, about 0.25~3.0°.

Here, the two axial lines may not cross each other but may be skew lines. That is, they may have the relationship that they do not cross each other but one of them passes by the neighboring portion of the other.

By using the shaft case 5A of FIG. 7 or the shaft case 5B of FIG. 8, the face progression and lie angle of the shaft can be adjusted.

In the case that the shaft case 5A of FIG. 7 is used, as shown in FIG. 7, the shaft 4 can be got nearer to the face side by the eccentric distance than the case shown in FIG. 5.

From the state shown in FIG. 7, when the bolt 7 is removed and the shaft case 5A is once pulled out from the tubular portion 3*h* and is then rotated by 90°, 180°, or 270°, the position of the shaft 4 can be translated and changed to the heel side, back side or toe side. By setting the position of the shaft 4 on the toe side or heel side, the distance from the axis of the shaft to the center of gravity of the head can be changed. In FIG. 7, the distance between the head center of gravity and shaft 4 is greatest and, in a state where the shaft 4 is rotated by 180° from this state, the distance between the head center of gravity and shaft 4 is smallest. By changing the position of the shaft 4 to the face side or back side, the face progression can be changed.

As shown in FIG. 8, when a shaft case 5B with the shaft insertion hole 5*h* inclined relative to the axis of the tubular portion 3*h* is used, the inclination of the shaft 4 can be set different from one shown in FIGS. 1 and 5.

In FIG. 8, the axial line of the shaft 4 is inclined toward the face side with respect to the axial line of the tubular portion 3*h*. When the shaft case 5 is turned by 90°, 180°, or 270° from the state shown in FIG. 8, the inclination direction of the shaft 4 can be changed. That is, the shaft 4 can be inclined toward the heel side, or toward the toe side, or toward the back side.

In this manner, by changing the direction of the inclination of the shaft 4, the lie angle and slice angle can be changed.

Referring to the lie angle, when the shaft 4 is inclined toward the heel side, the lie angle is smallest and provides a flat lie, whereas, when the shaft 4 is inclined toward the toe side, it provides an up lie.

For the slice angle, in FIG. 8 where the shaft 4 is most inclined toward the face side, there is provided a hook face where the face surface is most closed. On the other hand, when the shaft 4 is inclined most backwardly, there is provided a slice face where the face surface is opened most.

As described above, with use of the shaft case 5B of FIG. 8, the inclination direction of the shaft 4 relative to the head 1 can be changed and thus the lie angle and slice angle can be changed.

In this golf club, the flange portion 5*b* is tapered. However, an enlarged diameter portion having a flat flange shape may also be provided and a ferrule may be mounted on the upper side of such portion.

Here, since a thin-piece-shaped elastic member 8A constituted of rubber, elastomer, synthetic resin or the like is interposed between the shaft case 5 and shaft case insertion hole 8*b*, when the golf club is impacted on a ball, impact and vibrations can be absorbed.

Figure 9A:
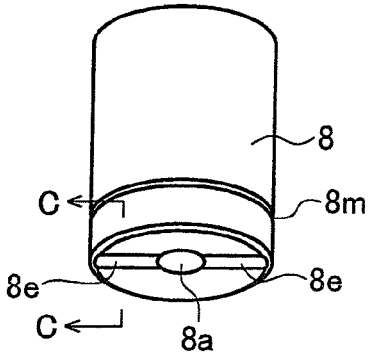
FIGS. 9A to 9E are section views of a fourth embodiment.
Figure 9B:
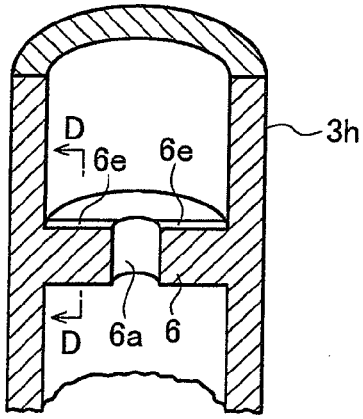
Figure 9C:
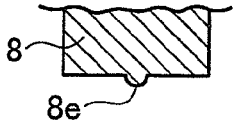
Figure 9E:
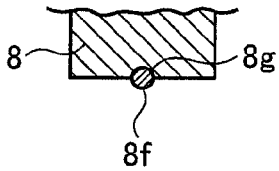
Figure 9D:
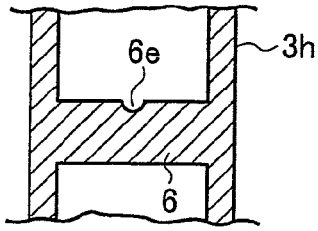

In this embodiment, the projecting portion 8*c* and recessed portion 6*b* to prevent the spacer 8 against rotation are formed as the dowel pin and dowel hole. However, as shown in FIGS. 9A to 9D, there may also be provided a projecting portion 8*e* provided on the bottom surface of the spacer 8 and extending in the diameter direction of the spacer 8 and a recessed portion 6*e* formed in the upper surface of the partition plate section 6 and extending in the diameter direction of the partition plate section 6. The projecting strip portion 8*e* may be formed integrally with the spacer 8, or, as shown in FIG. 9E, there may also be formed a recessed groove 8*g* in the bottom surface of the spacer 8, and a bar-shaped portion 8*f* may be fixed to the recessed groove 8*g* by adhesion, by welding, by brazing or the like. In FIGS. 9A and 9B, the projecting strip portion 8*e* and recessed strip portion 6*e* extend in the diameter direction; however, they may also extend in the radial direction. Here, FIG. 9C is a section view taken along the C-C line shown in FIG. 9A, and FIG. 9D is a section view taken along the D-D line shown in FIG. 9B. FIG. 9E is a section view of a similar portion to FIG. 9C.

The above shaft case and bolt may preferably be made of metal, especially, aluminum or titanium or an alloy constituted of aluminum and titanium. The spacer 8 may preferably be made of metal, FRP, or synthetic resin.

The head is not limited to any specific material but, in the case of a golf club head of a wood type, it can be made of, for example, titanium alloy, aluminum alloy, or stainless steel.

In the above embodiment, although the spacer 8 and shaft case 5, 5A, 5B include four slopes which constitute a regular square pyramid, there may also be employed a regular polygonal pyramid including three or five or more slopes. The leading end portion of the shaft case and the deep portion of the shaft case insertion hole may also have a concave polygonal section shape such as a star shape, or a gear-teeth-like section shape.

Here, as a grip to be mounted on the shaft 4, there can be used a shaft the section of which has a complete round shape. For example, of the grip outer peripheral surface, the lower side surface to be directed toward the ground when a player takes an address position can be formed such that it is raised more than the other surface portions. With use of this shape, when the direction of the shaft case 5A, 5B is changed, there can be a case where the grip raised portion cannot be directed toward the ground. Therefore, in the invention, a grip having a complete round section shape may preferably be used.

In the above embodiment, the golf club head is of a wood type. However, the invention can also be applied to a golf club head of any one of a utility type, an iron type, and a patter type.

What is claimed is:

1. A golf club comprising:

a shaft;

a head mounted on a leading end of the shaft; and a substantially cylindrical shaft case fixed to the leading end of the shaft, wherein:

the shaft case is inserted into the tubular portion of the hosel of the head;

the tubular portion includes a partition plate section in the lower portion thereof;

a spacer is interposed between the leading end of the shaft case and partition plate section;

the shaft case is unrotatably engaged with the spacer;

the spacer and partition plate section respectively include stopper portions for preventing the rotation of the spacer; and a bolt inserted through bolt insertion holes respectively formed in the partition plate section and spacer from the sole side of the head is screwed into the shaft case, whereby the shaft case is fixed to the head.

2. The golf club as set forth in claim 1, wherein the axis of the shaft is coaxial with the axis of the tubular portion.

3. The golf club as set forth in claim 1, wherein the axis of the shaft is inclined with respect to the axis of the tubular portion.

4. The golf club as set forth in claim 1, wherein the axis of the shaft and the axis of the tubular portion are parallel to each other.

5. The golf club as set forth in claim 1, wherein:

the spacer includes a shaft case insertion hole; and the lower end side of the shaft case and the shaft case insertion hole respectively have a polygonal section shape and are engaged with each other.

* * * * *